United States Patent [19]

Velencei

[11] Patent Number: 4,836,153

[45] **Date of Patent: * Jun. 6, 1989**

[54] TWO-PISTON INTERNAL COMBUSTION ENGINES

[76] Inventor: John Velencei, Daly Rd., Far Hills, N.J. 07931

[ * ] Notice: The portion of the term of this patent subsequent to Aug. 4, 2004 has been disclaimed.

[21] Appl. No.: 78,226

[22] Filed: Jul. 27, 1987

Related U.S. Application Data

[63] Continuation-in-part of Ser. No. 674,944, Nov. 26, 1984, Pat. No. 4,683,845.

[51] Int. Cl.[4] ..... F02B 33/04

[52] U.S. Cl. ..... 123/73 PP; 123/73 A; 123/65 VC

[58] Field of Search ..... 123/25 R, 65 VC, 65 V, 123/73 R, 51 R, 51 BC, 51 BA, 51 BD, 188 B

[56] References Cited

U.S. PATENT DOCUMENTS

| | | | |
|---|---|---|---|
| 1,292,322 | 1/1919 | Hunt | 123/73 PP |
| 1,540,286 | 6/1925 | Roberts | 123/73 PP |
| 2,316,790 | 4/1943 | Hickey | 123/65 VC |
| 2,337,245 | 12/1943 | Jacklin | 123/65 VC |
| 2,367,565 | 1/1945 | Curtis | 123/65 VC |
| 2,389,510 | 1/1944 | Olsson | 123/65 OC |
| 2,442,082 | 5/1948 | French | 123/65 VC |
| 2,447,041 | 8/1948 | Sues | 123/65 VC |
| 2,516,708 | 7/1950 | Lugt | 123/73 PP |
| 2,572,768 | 10/1951 | Scheeberger | 123/73 PP |
| 3,971,297 | 7/1976 | Fox | 123/73 PP |
| 4,004,557 | 1/1977 | Acker | 123/73 PP |
| 4,066,050 | 1/1978 | Ford-Dunn | 123/73 PP |
| 4,359,017 | 11/1972 | May | 123/73 R |
| 4,388,895 | 6/1973 | Boyesen | 123/73 PP |
| 4,395,978 | 8/1973 | Boyesen | 123/73 PP |
| 4,683,845 | 8/1987 | Velencei | 123/73 PP |

FOREIGN PATENT DOCUMENTS

| | | | |
|---|---|---|---|
| 0159918 | 10/1982 | Japan | 123/73 A |
| 362453 | 12/1931 | United Kingdom | 123/65 W |

*Primary Examiner*—Carl Stuart Miller

[57] ABSTRACT

The present invention relates to an internal combustion engine cylinder assembly comprising a first cylinder having substantially vertically disposed interior walls defining a firing chamber therein; first piston means housed within the firing chamber and adapted for vertical reciprocation within the firing chamber; gas inlet channels means in the lower portion of the firing chamber; a crankcase housing having a gas compression chamber disposed therein; valve means adapted to permit fresh air mixture to be charged into the gas compression chamber upon the depressuring of the chamber; fuel introduction means for introducing liquid fuel into the upper portion of the firing chamber; second cylinder means positioned at the upper end of the first cylinder and having an exhaust chamber therein and a second piston means disposed within the exhaust chamber and adapted for vertical reciprocation therein, the exhaust chamber communicating with the upper end of the firing chamber; the second cylinder means being provided in the lower portion thereof with at least one exhaust gas port adapted for cyclic opening and closing to permit removal of exhaust gases from the firing chamber; at least a portion of the first cylinder extending downwardly into the gas compression chamber and being adapted to house at least a portion of the first piston means during the full downstroke of the first piston means; the upper portion of the crankcase having inwardly coverging walls to define a converging gas space in the upper portion of the gas compression chamber annularly about the downwardly extending first cylinder portion.

22 Claims, 3 Drawing Sheets

TWO-PISTON INTERNAL COMBUSTION ENGINES

CROSS REFERENCE TO RELATED APPLICATIONS

This application is a continuation-in-part of my co-pending application Ser. No. 674,944, filed Nov. 26, 1984, now U.S. Pat. No. 4,683,845 and is related to my co-pending Ser. No. 674,945, filed Nov. 26, 1984, now U.S. Pat. No. 4,682,570 the disclosures of which are hereby incorporated herein in their entirety, and is related to my co-pending application Ser. No. 78,225, filed July 27, 1987.

BACKGROUND OF THE INVENTION

1. Field of the Invention

This invention relates generally to the field of internal combustion engines, and more particularly to two-stroke internal combustion engines.

2. Description of the Prior Art

U.S. Pat. No. 1,292,322 is directed to a water cooled two cycle gas engine provided with a dual walled cylinder having a lower, rotatably mounted perforated valve member for gas entry and accuated by a first cam and spring/rocker arm arrangement. Gases exhaust through an upper reciprocating sleeve valve member controlled by a cam movably connected to the shaft to the cylinder's piston connecting rod is also connected.

U.S. Pat. No. 1,540,286 relates to an internal combustion piston engine provided with exhaust valves located in the upper portion of the cylinder. The engine is also provided with either a rotary gas inlet or a crankcase gas inlet valve communicating with a crankcase gas pressuring chamber.

U.S. Pat. No. 2,337,245, discloses an internal combustion engine of the two stroke type having a set of gas inlet ports at one end of the cylinder and a set of gas exhaust ports at the other cylinder end. Each set of gas ports is opened and closed by means of a separate reciprocating piston which is positioned in the cylinder.

U.S. Pat. No. 2,516,708 relates to a single-acting two-stroke cyclic internal combustion engine having an associated air scavenging chamber adjacent to the gas inlet end of the cylinder.

U.S. Pat. No. 2,572,768 also relates to a two-stroke internal combustion engine having gas inlet ports providing swirling motion by tangential gas injection arrangements.

U.S. Pat. No. 2,316,790 relates to an internal combustion engine having a variable compression ratio which is provided by an auxiliary piston which reciprocates in synchronism with the working piston and functions to open and close valve ports of the engine and by a mechanism for ranging the stroke of the auxiliary piston.

U.S. Pat. No. 3,971,297 relates to a two cycle engine with three peripheral, oppositely displaced by-passes about the piston, to increase the breathing of the engine by-passing virtually the entire perimeter of the piston.

U.S. Pat. No. 4,004,557 discloses a piston-cylinder assembly having a cup-like upper extension of the piston, and a plurality of vertical passages between the crankcase and the cylinder.

U.S. Pat. No. 4,066,050 relates to two stroke internal combustion engines having a plurality of transfer ports controlled by the movement of the piston wherein some, but not all, of the transfer ports are provided with pressure-responsive non-return valves which are slightly biased toward the closed position, to restrict gas flow through those passages under predetermined engine conditions.

U.S. Pat. No. 4,359,017 relates to an internal combustion engine having diametrically opposed, co-axial cylinders, in each of which a piston in housed.

Japanese Patent Publication No. 57-159,918 relates to two cylinder engines wherein the connecting rod is cooled and lubricated by means of openings in the non-thrusting section of a piston and by providing an auxiliary scavenging passage which connects the openings to a scavenging passage in the process of scavenging.

British Pat. No. 362,453 relates to a two stroke compression ignition internal combustion engine.

SUMMARY OF THE INVENTION

Figure 1:
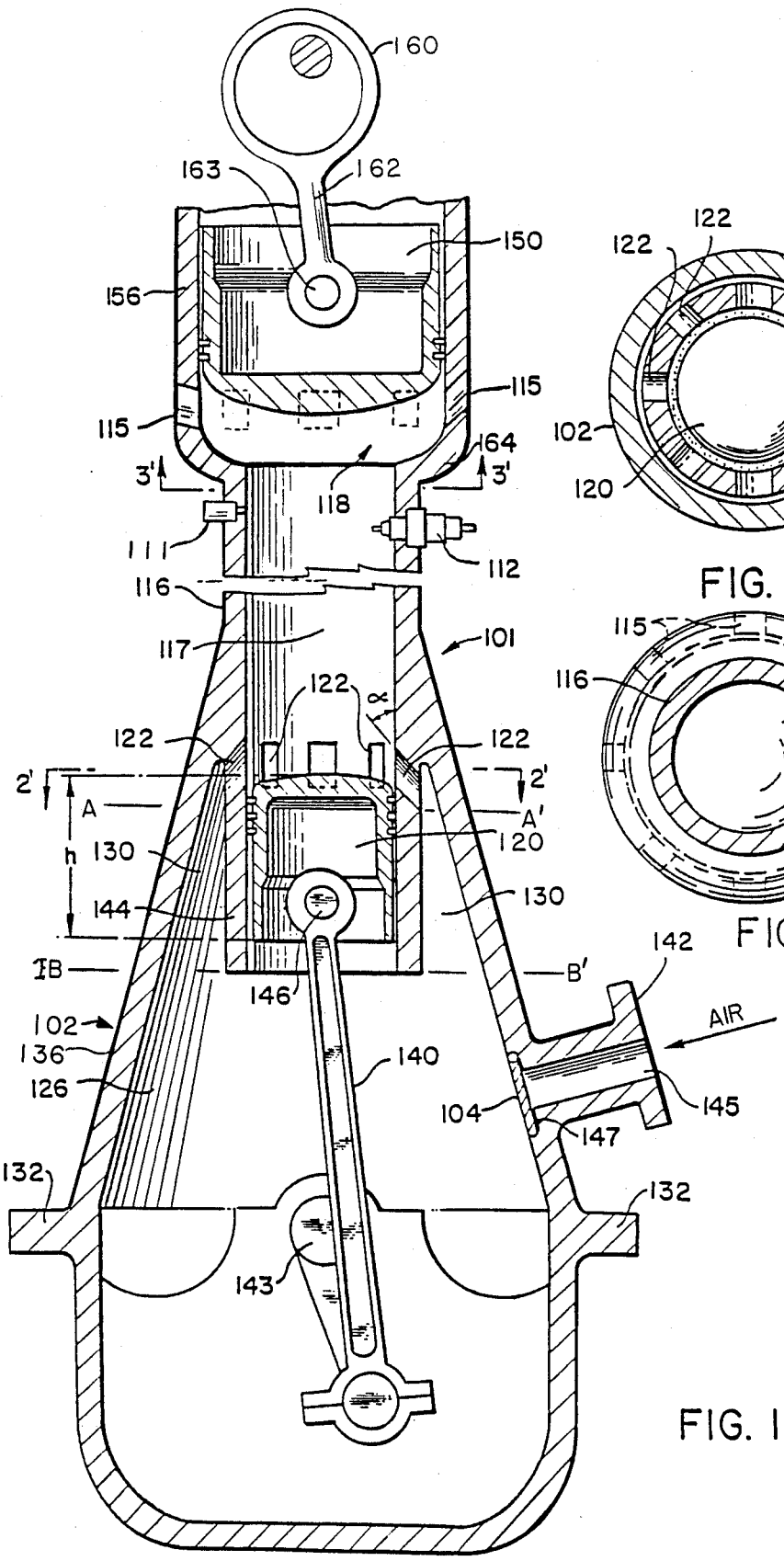
FIG. 1 is a vertical cross-sectional view of one embodiment of a fuel-injected, spark ignited internal combustion engine of this invention, with a single cylinder thereof being illustrated.

An internal combustion engine cylinder assembly comprising a first cylinder having substantially vertically disposed interior walls defining a firing chamber therein; first piston means housed within the firing chamber and adapted for vertical reciprocation within the firing chamber; gas inlet channels means in the lower portion of the firing chamber; a crankcase housing having a gas compression chamber disposed therein; valve means adapted to permit fresh air to be charged into the gas compression chamber upon the depressuring of the chamber; fuel introduction means for introducing liquid fuel into the upper portion of the firing chamber; second cylinder means positioned at the upper end of the first cylinder and having an exhaust chamber therein and a second piston means disposed within the exhaust chamber and adapted for vertical reciprocation therein, the exhaust chamber communicating with the upper end of the firing chamber; the second cylinder means being provided in the lower portion thereof with at least one exhaust gas port adapted for cyclic opening and closing to permit removal of exhaust gases from the firing chamber; at least a portion of the first cylinder extending downwardly into the gas compression chamber and being adapted to house at least a portion of the first piston means during the full downstroke of the first piston means; the upper portion of the crankcase having inwardly converging walls to define a converging gas space in the upper portion of the gas compression chamber annularly about the downwardly extending first cylinder portion, the gas inlet channels providing gaseous communication between the firing chamber and the converging gas space; the first piston means being arranged to cyclically open and close the gas inlet channels to permit the gaseous communication with the converging gas space; the second piston means being adapted to cyclically open and close the gas exhaust ports to control the removal of exhaust gases from the firing chamber; fuel ignition means for igniting a compressed fuel/air mixture in the firing chamber; the first piston means cooperating with the second piston means, the fuel introduction means and the fuel ignition means for controlling the charging of fresh air and fuel into the firing chamber and the pressurization and ignition thereof in the firing chamber to generate power, and to remove from the firing chamber the thus formed exhaust gases.

DETAILED DESCRIPTION OF THE INVENTION

Referring to FIGS. 1–3 and 4–6, a single cylinder of two embodiments of engines of this invention is illustrated. It will be understood that engines of this invention can comprise a single such cylinder or a multiple of such cylinders, all the cylinders of said engine being the same in principle and mechanism, the particular engines shown being of especially light construction and designed for use in motorcycles, boats, electrical generators, chain saws, weed trimmers and the like.

As illustrated, the engine is air cooled, as is preferred, although it will be understood that water or oil cooling can be used if desired, by provision of a suitable jacket about at least a portion of cylinder 116 to contain the selected cooling fluid and to maintain the cooling fluid in wall cooling relationship with the outer walls of cylinder 116. It will be understood that the outer walls 116 can be provided with suitable conventional cooling fins to assist in the convection cooling of the cylinder walls, and hence the engine itself.

Figure 2:
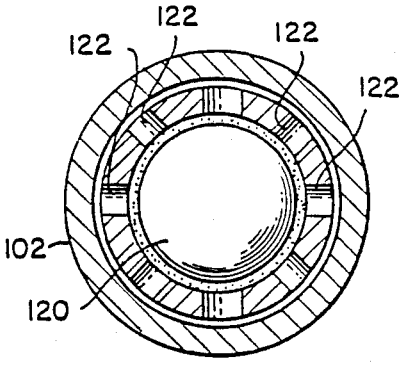
FIG. 2 is an enlarged horizontal cross-sectional view of the cylinder of FIG. 1 taken along line 2'—2' in FIG. 1.
Figure 3:
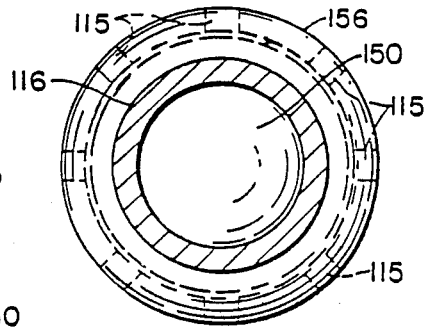
FIG. 3 is an enlarged horizontal cross-sectional view of the cylinder of FIG. 1 taken along line 3'—3' in FIG. 1.

In the embodiment illustrated in FIGS. 1–3, my engine, indicated generally at 101, comprises a crankcase housing 102 which is provided with a suitable engine mounting means 132 and which is associated with a crankshaft 143 and a connecting piston rod 140, which is in turn rotatably connected to a piston 120 by means of a first wrist pin 146.

A gas compression chamber 126 is provided within the upper portion 136 of crankcase housing 102 which is in cyclic gas communication with air inlet 145. Gas compression chamber 126 can comprise an elongated chamber as illustrated in the Figure, although other geometries (e.g., a substantially circular chamber 126) can also be employed.

Inlet 145 is opened and closed by means of valve means which can comprise reed valve 104 positioned in a recessed portion 147 of the inner walls of crankcase housing 102. In the embodiment illustrated, reed valve 104 is pivoted at 138 for pivotal motion inwardly into chamber 126 to permit gas flow thereinto from gas passage 145 when the gas pressure in chamber 126 is less than the pressure in passage 145. Reed valve 104 is prevented from pivoting into passage 145 upon pressuring of chamber 126 by suitably sizing recessed portion 147 to securely seat valve 104 therein when valve 104 is in the closed position (as shown in FIG. 1) and the fit of valve 104 within recessed portion 147 should be such as to substantially prevent the backflow of gases from gas chamber 126 into passage 145 when chamber 126 is pressured, as will be described in more detail below. Reed valve 104 can also be positioned in passage 145 for controlling the flow of air into chamber 126. One or more such reed valves 104 can be provided, and can be located in the walls or other surfaces (e.g., the bottom surfaces) of housing 102. Preferably, reed valve 104 is located below the lower lowermost level reached by piston 120 in operation of the engine. Valve means 104 can also comprise a rotary valve, or a piston-type valve positioned, e.g. in passage 145, for controlling the flow of air into chamber 126.

Cylinder 116 comprises a hollow, substantially cylindrical member adapted to house therein a firing chamber 117 and first piston 120 in the lower portion of chamber 117 so as to permit piston 120 to vertically reciprocate in firing chamber 117. Preferably, cylindrical member 116 and firing chamber 117 are each substantially elongated, although it will be understood that such geometries are not essential, and e.g., member 116 can be constructed to define a substantially square firing chamber 117 wherein the bore, or internal diameter of the chamber, is substantially equal to the stroke of piston 120.

At least a portion of the cylinder, indicated at 144, projects downwardly into gas chamber 126, to house at least a portion of piston 120 at its lowest (downstroke) point. Preferably, the length of wall portion 144 thus positioned will range from about 0.1 to 2 times the height "h" of piston 120, and more preferably from about 0.4 to 1.5 times such height "h". However, such dimensions are only preferred and other lengths of wall portion 144 can also be used.

Cylinder 116 is securely affixed to crankcase housing 102 and, as is illustrated in FIG. 1, cylinder 116 and crankcase housing 102 can be formed as a unitary structure.

A plurality of spaced apart gas channels 122 are provided in the lower portion of the walls of cylinder 116 adjacent to walls 144 to permit gaseous communication between gas compression chamber 126 and firing chamber 117. The manner in which such gas channels 122 are opened and closed will be described below. The number and precise positioning of such channels 122 about the preiphery of cylinder 116 can vary, but preferably channels 122 are spaced substantially evenly about the circumference of the cylinder wall portion 144 as shown in FIG. 2, and provide direct gaseous communication therebetween. The number and size of such channels 122 is preferably selected as that which provides the maximum air flow, hence the greatest cross sectional area, consistent with the need to maintain the structural integrity of walls 116 and 144. Generally from about 2 to 20 such channels will be employed, with from about 6 to 10 being preferred. Where a plurality of such channels 122 are used, each such channel 122 will in FIG. 2) which is from about 1 to 10 percent, and more preferably from about 3 to 8 percent, of the total cross sectional area of the annulus (defined in such view, inclusive of all such channels 122) of cylinder wall 116 Also, the total area of such channels 122 will generally range from about 10 to 60 percent or more, and preferably from about 25 to 45 percent, of the total cross sectional area of such cylinder wall annulus.

At the upper end of crankcase housing 102, in accordance with the illustrated embodiment of my invention, the walls of housing 102 are inwardly converging (e.g., inwardly sloping) to define upper converging gas spaces 130 within gas chamber 126 which gas spaces are positioned about lower cylinder wall 144. By "converging" gas space herein it is meant that the upper portion of walls 136 and the downwardly extending wall portion 144 which define gas space 130 (which is located annularly about the walls 144) are arranged so that the cross-sectional area of gas space 130 at the lowermost surface of channel 122 (taken along line A—A' in FIG. 1) is less (and preferably at least 5%, and more preferably at least 25% (e.g. from about 50 to 200% or more) less) than the cross-sectional area of gas space 130 at the lowermost level to which walls 144 extend into chamber 126 (taken along line B–B' in FIG. 1).

Each gas channel 122 directly communicates the uppermost part of converging gas space 130 to firing chamber 117, to permit the rapid and efficient gas charging of chamber 117. Each such gas channel 122 is preferably substantially circular in cross section (in the direction of gas flow therethrough) and at the point the channel 122 opens into the inner surface of walls 116 is preferably angularly disposed such that the center longitudinal axis of each channel 122 forms an angle "$\alpha$" with the vertical, inner wall of chamber 117, of from about 10 to 60 degrees, most preferably from about 30 to 50 degrees. The combination of such converging gas space 130 and angularly disposed gas channels 122 provides gas charging with high velocities and efficiencies.

At the upper end of cylinder 116 is provided at least one conventional spark plug 112 (e.g. 1 to 6 spark plugs) (or other fuel ignition means) to permit the air/fuel mixture in chamber 117 to be ignited. Also at the uppermost end of cylinder 116 there is provided an exhaust piston means comprising an expanded cylinder 156 housing piston 150, cam means 160 and exhaust ports 115. One or more exhaust ports 115 are located at the lower portion of expanded cylinder 156 and permit gaseous communication between the uppermost end of firing chamber 117 and an exhaust manifold (not shown) or other conventional exhaust disposal means to permit the collection and withdrawal of exhaust gases from cylinders 116 and 156.

Also in the upper portion of cylinder walls 116 is positioned fuel introduction means 111 (which can comprise fuel injectors for spark-ignited gasoline engines and diesel fuel injectors for compression ignited engines) for injection of liquid fuel through an internal passage communicating the firing chamber 117 with a conventional fuel supply (not shown) external to the engine. More than one such injector may be employed per cylinder 116, e.g. from 1 to 6 such injectors per cylinder, to maximize the rate of fuel flow to the engine.

While fuel injector means 111 and spark plug means 112 are illustrated in FIG. 1 as substantially horizontally positioned, it will be understood that either or both can be angled to the horizontal, and are preferably downwardly sloping into the chamber for ease of access to, and removal of, each for maintenance purposes. Preferably, both fuel injection means 111 and spark plug means 112 are located as close to the upper surface of cylinder 117 as possible (without coming into contact with second piston 150 during operation of the engine) to permit the maximum compression of the fuel/air mixture in chamber 117 and hence to derive greater engine-generated power from the combustion of the thus-compressed gases.

Piston 150 is adapted to reciprocate vertically within an elongated chamber 118 defined within expanded cylinder section 156. Such motion of piston 150 is controlled by cam means 160 which comprises a cam and connecting rod 162 to which piston 150 is rotatably connected by means of second wrist pin 163. The length of the stroke of piston 150 is sufficient to open and close exhaust ports 115.

The number, size and precise positioning of the exhaust ports 115, similarly to the gas inlet channels 122, can vary, and thus from about 1 to 20 such exhaust ports 115 of substantially cylindrical cross section will be generally employed, each such port having a cross sectional area of from about 1 to 10 percent of the total cross sectional area of the cylinder walls 156 (inclusive of such ports 115) taken transversely to the longitudinal axis of cylinder 156, and the total cross sectional area of such ports 115 being from about 10 to 60 percent or more of the total cross sectional area of such an annulus of cylinder 156.

Upper expanded cylinder 156 preferably defines an expanded cylindrical elongated chamber 118 therein having a diameter which is greater (and preferably from about 10 to 150 percent, and more preferably from about 30 to 80 percent greater) than the diameter of firing chamber 117. Such an arrangement of exhaust ports 115 and enlarged second upper piston 150 permits the greatly improved efficiencies in gas exhaust removal from firing chamber 117, and therefore permits the engine of this invention to be operated at high revolutions per minute (that is, at high rates of opposed-piston cyclic reciprocations) with smooth, reduced-turbulence operation. If desired, upper chamber 118 can be of substantially equal diameter to firing chamber 117.

The length of firing chamber 117 and the positioning of spark plug 112 is such that at the full upper stroke of first piston 120 (such position not being shown in the drawings), piston 120 will not come into contact with spark plug 112 or fuel introduction means 111 or with any portion of the expanded cylinder 156 and its associated piston 150. At its full lower stroke piston 120 uncovers gas inlet channels 122 to permit gaseous communication between gas compression chamber 126 and firing chamber 117. In turn, lower portion 144 of cylinder 116 is of a sufficient length to ensure that piston 120, at its lowest point, remains at least partially housed within the cylindrical extension of chamber 117 formed by the inner walls of cylinder portion 144, as described above.

Referring to upper piston 150, in its full upper stroke, the exhaust ports 115 are uncovered to allow the outward flow of gases from firing chamber 117. At its lowest point, which occurs at its full downward stroke, piston 150 fully covers exhaust ports 115 to prevent the flow of gases therethrough either into or out of the firing chamber 117 during compression and ignition of the fuel/air mixture therein, as will be described in more detail below.

In the usual two-stroke operation, air (which can be introduced in the proper or desired ratio to the fuel by conventional air-metering means) is drawn into gas compression chamber 126 by means of valve 104 when piston 120 moves in its upstroke after the closing of channels 122, thereby depressuring chamber 126 sufficiently to permit fresh air to pass thereto from passage 145. In its downstroke, piston 120 pressurizes the air trapped in chamber 126 upon closing of valve 104. Upon reaching a lower point in its downstroke, the upper surface of piston 120 uncovers, and thus opens, gas channels 122 and permits the pressurized air to pass from coverging gas space 130 through channels 122 into firing chamber 117, in which the pressure had been previously lowered as a result of the piston 120 downstroke and the opening of exhaust ports 115 by means of the upstroke of upper piston 150.

Exhaust ports 115 are caused by the downstroke of upper piston 150 to close after the fresh air is introduced into chamber 117 to permit the fresh gases to be pressured during the upstroke of piston 120. If desired, the timing of the downstroke of upper piston 150 can be adjusted such that exhaust ports 115 remain open for a portion of the upstroke of lower piston 120 to permit the lowermost gas layer (which comprises the fresh air) to assist in more completely forcing the exhaust gases from chamber 117. At the desired point in the upward travel of lower piston 120, when gas exhaust ports 115 are closed, fuel is injected into chamber 117 by means 111 and thereafter spark plug 112 is activated to cause the thus pressured fuel/air mixture to explosively ignite and to thereby force piston 120 downwardly, whereupon exhaust ports 115 are opened by the upward motion of the upper piston 150 to allow the thus-formed exhaust gases to exit chamber 117. The timing and precise manner of operation of pistons 150 and 120 and their associated cam means, and of fuel introduction means 111 and spark plug 112 is fully conventional, and since such will be readily understood by one of ordinary skill in the art having reference to the instant description, further detailed explanation or description thereof will not be given herein.

Figure 4:
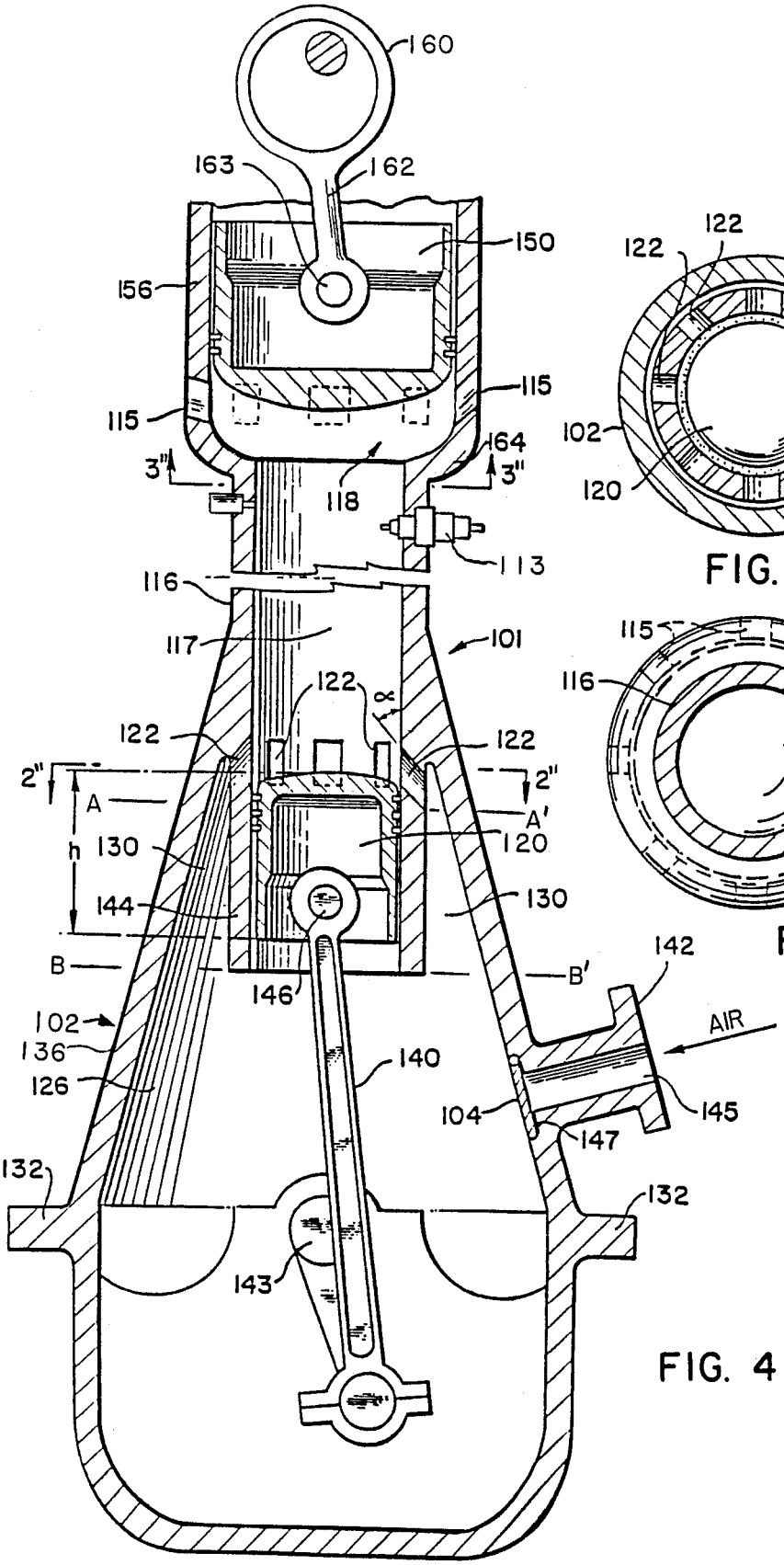
FIG. 4 is a vertical cross-sectional view of a second embodiment of a diesel, compression ignited internal combustion engine of this invention, with a single cylinder thereof being illustrated.
Figure 5:
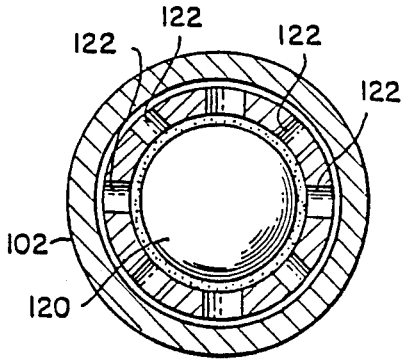
FIG. 5 is an enlarged horizontal cross-sectional view of the cylinder of FIG. 4 taken along line 2"—2" in FIG. 1.
Figure 6:
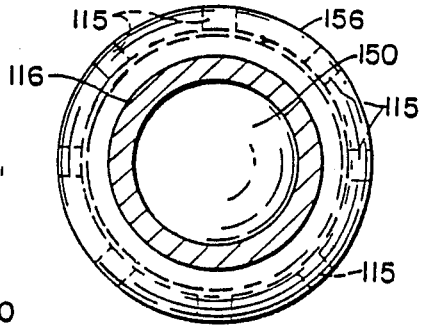
FIG. 6 is an enlarged horizontal cross-sectional view of the cylinder of FIG. 4 taken along line 3"—3" in FIG. 4.

FIG. 4 illustrates a diesel engine in accordance with the present invention, wherein fuel introduction means 111 is adapted for introduction of liquid diesel fuel into firing chamber 117, and wherein one (or more) glow plug 113 is provided through the wall 116 to assist in cold starting (and cold-condition operation) of the engine. In the illustrated diesel engine, the fuel ignition means is provided by conventional high compression ratios in the firing chamber (e.g., employing compression ratios of from about 1:10 to 1:40, more usually from 1:15 to 1:30 and : preferably from 1:18 to 1:25). The number of such diesel fuel injectors 111 and glow plugs 113, and the location and operation thereof, is as described above for the fuel injectors and spark plugs of the engine illustrated in FIGS. 1–3, as is the manner of arrangement, function and cooperative operation of the remaining engine components.

Figure 7:
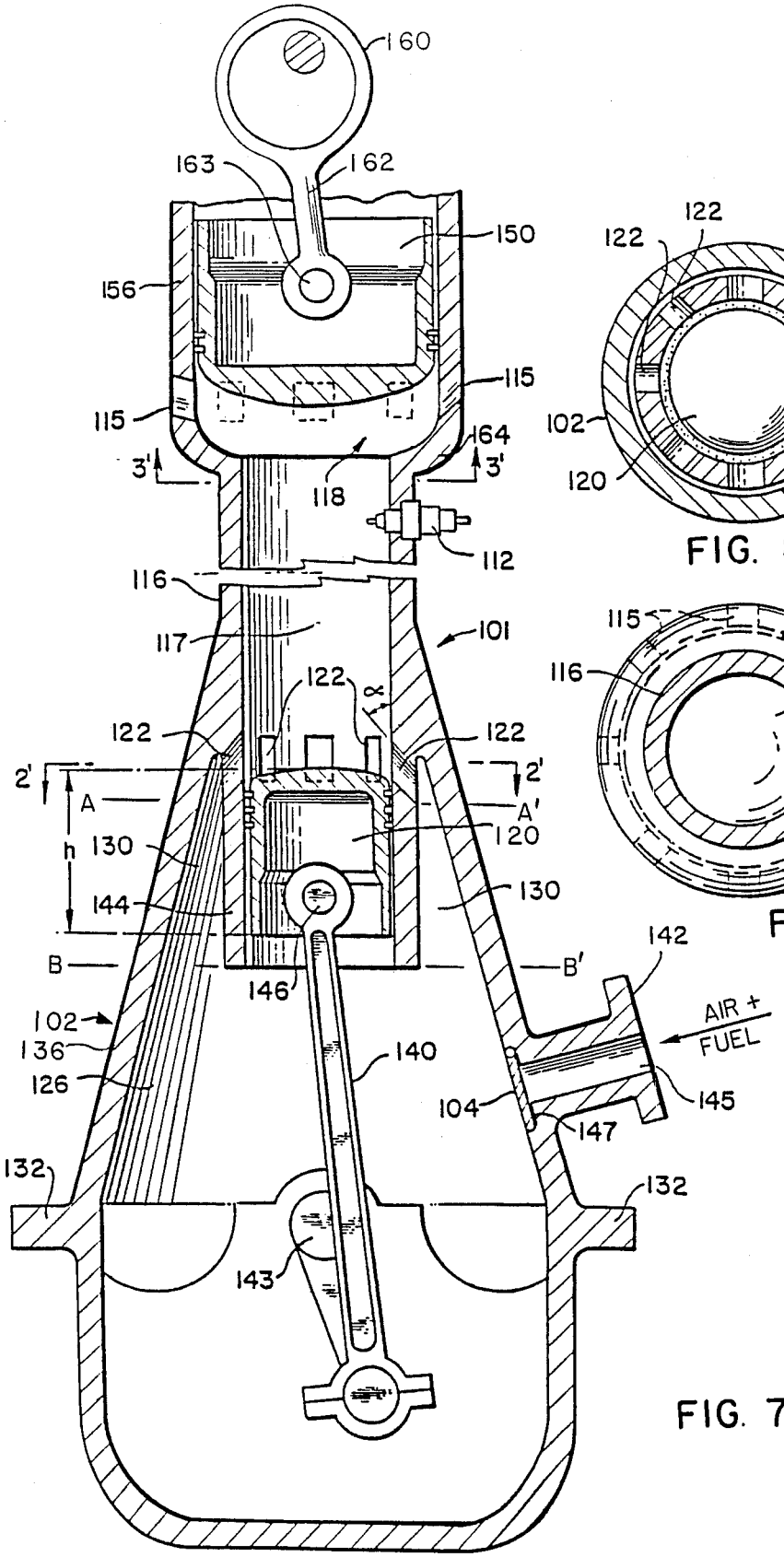
FIG. 7 is a vertical cross-sectional view of a third embodiment of a fuel-injected, spark ignited internal combustion engine of this invention, with a single cylinder thereof being illustrated.
Figure 8:
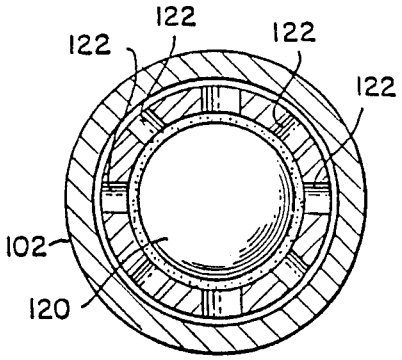
FIG. 8 is an enlarged horizontal cross-sectional view of the cylinder of FIG. 7 taken along line 2'—2' in FIG. 7.
Figure 9:
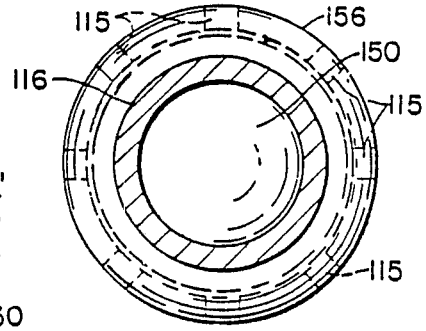
FIG. 9 is an enlarged horizontal cross-sectional view of the cylinder of FIG. 7 taken along line 3'—3' in FIG. 7.

FIG. 7 illustrates another embodiment of the engines of my invention wherein the fuel and air are introduced into the gas compression chamber 126 as fuel/air mixtures, for compression therein and for introduction of the resulting compressed fuel/air mixtures into firing chamber 117 via gas channels 122 as described above. In this embodiment, the use of fuel introduction means 111 is not required, although such fuel introduction means 111 for direct introduction of fuel into chamber 117 can be used in combination with the introduction of fuel into compression chamber 126 if desired. The manner of arrangement, function and cooperative operation of the remaining engine components is as described above for the first two above-discussed embodiments.

It is to be understood that the form of my invention herein shown and described is to be taken as a preferred example of the same and that various changes in the shape, size, and arrangement of parts may be resorted to without departing from the spirit of my invention, or the scope of the claims hereinafter presented.

I claim:

1. An internal combustion engine cylinder assembly comprising a first cylinder having substantially vertically disposed interior walls defining a firing chamber therein; first piston means housed within said firing chamber and adapted for vertical reciprocation within said firing chamber; gas inlet channels means in the lower portion of said firing chamber; a crankcase housing having a gas compression chamber disposed therein; valve means adapted to permit fresh air to be charged into said gas compression chamber upon the depressuring of said chamber; fuel introduction means for introducing fuel into the upper portion of said firing chamber to form fuel/air mixtures therein; fuel ignition means for igniting a compressed fuel/air mixture in said firing chamber; second cylinder means positioned at the upper end of said first cylinder and having an exhaust chamber therein and a second piston means disposed within said exhaust chamber and adapted for vertical reciprocation therein, said exhaust chamber communicating with the upper end of said firing chamber; said second cylinder means being provided in the lower portion thereof with at least one exhaust gas port adapted for cyclic opening and closing to permit removal of exhaust gases from said firing chamber; at least a portion of said first cylinder extending downwardly into said gas compression chamber and being adapted to house at least a portion of said first piston means during the full downstroke of said first piston means; the upper portion of said crankcase having inwardly converging walls to define a converging gas space in the upper portion of said gas compression chamber annularly about said downwardly extending first cylinder portion, said gas inlet channels providing gaseous communication between said firing chamber and said converging gas space; said first piston means being arranged to cyclically open and close said gas inlet channels to permit said gaseous communication with said converging gas space; said second piston means being adapted to cyclically open and close said gas exhaust ports to control the removal of exhaust gases from said firing chamber; said first piston means cooperating with said second piston means, said fuel introduction means and said fuel ignition means for controlling the charging of fresh air and fuel into said firing chamber from said gas compression chamber and the pressurization and ignition thereof in said firing chamber to generate power and to remove from said firing chamber the thus formed exhaust gases.

2. The internal combustion engine cylinder assembly of claim 1 wherein said second cylinder means is adapted to provide an exhaust chamber therein having a diameter which is greater that the diameter of said firing chamber.

3. The internal combustion engine cylinder assembly according to claim 1 wherein said downwardly extending portion of said first cylinder has a length of from about 0.4 to 1.5 times the height of said first piston means.

4. The internal combustion engine cylinder assembly according to claim wherein said gas inlet channels are spaced substantially evenly about the circumference of said firing chamber's lower portion.

5. The internal combustion engine cylinder assembly according to claim 4 wherein a total of from about 6 to 10 of said gas inlet channels are provided about said lower circumference in said firing chamber.

6. The internal combustion engine cylinder assembly according to claim 1 wherein each said gas inlet channel is disposed such that its center longitudinal axis forms an angle of from about 10 to 60 degrees with said vertically disposed interior walls of said elongated firing chamber.

7. The internal combustion engine cylinder assembly according to claim 1 wherein said firing chamber is elongated.

8. The internal combustion engine cylinder assembly according to claim 7 wherein said valve means comprises at least one reed valve.

9. The internal combustion engine cylinder assembly according to claim 8 wherein said gas inlet channels in said lower portion of said firing chamber are spaced substantially evenly about the circumference of said firing chamber.

10. The internal combustion engine cylinder assembly according to claim 9 wherein a total of from about 6 to 10 of said gas inlet channels are provided about said lower circumference in said firing chamber.

11. The internal combustion engine cylinder assembly according to claim 10 wherein each said gas inlet channel is substantially circular in cross-section and is disposed such that its center longitudinal axis forms an angle of from about 10 to 60 degrees with said vertically disposed interior walls defining said firing chamber.

12. The internal combustion engine cylinder assembly according to claim 11 wherein said downwardly extending portion of said cylinder walls have a length of from about 0.4 to 1.5 times the height of said piston means.

13. An internal combustion engine cylinder assembly comprising a first elongated cylinder having substantially vertically disposed interior walls defining an elongated firing chamber therein; first piston means housed within said firing chamber and adapted for vertical reciprocation within said firing chamber; upwardly sloping gas inlet channel means in the lower portion of said firing chamber, the center longitudinal axis of each said gas inlet channel forming an angle of from about 10 to 60 degrees with said vertically disposed interior walls; a crankcase housing having a gas compression chamber disposed therein; valve means adapted to permit fresh air to be charged into said gas compression chamber upon the depressuring of said chamber; fuel introduction means for introducing fuel into said firing chamber; fuel ignition means for igniting compressed fuel/air mixtures in said firing chamber; second cylinder means positioned at the upper end of said first cylinder and having an exhaust chamber therein and a second piston means disposed within said exhaust chamber and adapted for vertical reciprocation therein, said exhaust chamber communicating with the upper end of said firing chamber; said second cylinder means being provided in the lower portion thereof with at least one exhaust gas port adapted for cyclic opening and closing to permit removal of exhaust gases from said firing chamber; at least a portion of said first elongated cylinder extending downwardly into said gas compression chamber and being adapted to house at least a portion of said first piston means during the full downstroke of said first piston means; the upper portion of said crankcase having inwardly sloping walls to define a converging gas space in the upper portion of said gas compression chamber annularly about said downwardly extending first cylinder portion, said gas inlet channels providing direct gaseous communication between said firing chamber and said converging gas space; said first piston means being arranged to cyclically open and close said gas inlet channels to permit said gaseous communication with said converging gas space; said second piston means being adapted to cyclically open and close said gas exhaust ports to control the removal of exhaust gases from said firing chamber; said first piston means cooperating with said second piston means, said fuel introduction means and said fuel ignition means for controlling the charging of fresh air and fuel into said firing chamber and the pressurization and ignition thereof in said firing chamber to generate power and to remove from said firing chamber the thus formed exhaust gases.

14. The internal combustion engine cylinder assembly of claim 13 wherein said second cylinder means is adapted to provide an exhaust chamber therein having a diameter which is greater than the diameter of said firing chamber.

15. The internal combustion engine cylinder assembly according to claim 13 wherein a total of from about 2 to 20 of said gas inlet channels are provided in said firing chamber's lower portion.

16. The internal combustion engine cylinder assembly according to claim 14 wherein said gas inlet channels are spaced substantially evenly apart about said firing chamber's lower portion.

17. The internal combustion engine cylinder assembly according to claim 14 wherein said downwardly extending portion of said elongated cylinder walls have a length of from about 0.4 to 1.5 times the height of said first piston means.

18. An internal combustion engine cylinder assembly comprising a first cylinder having substantially vertically disposed interior walls defining a firing chamber therein; first piston means housed within said firing chamber and adapted for vertical reciprocation within said firing chamber; gas inlet channels means in the lower portion of said firing chamber; a crankcase housing having a gas compression chamber disposed therein; valve means adapted to permit fresh air/fuel mixtures to be charged into said gas compression chamber upon the depressuring of said chamber; fuel ignition means for igniting a compressed fuel/air mixture in said firing chamber; second cylinder means positioned at the upper end of said first cylinder and having an exhaust chamber therein and a second piston means disposed within said exhaust chamber and adapted for vertical reciprocation therein, said exhaust chamber communicating with the upper end of said firing chamber; said second cylinder means being provided in the lower portion thereof with at least one exhaust gas port adapted for cyclic opening and closing to permit removal of exhaust gases from said firing chamber; at least a portion of said first cylinder extending downwardly into said gas compression chamber and being adapted to house at least a portion of said first piston means during the full downstroke of said first piston means; the upper portion of said crankcase having inwardly converging walls to define a converging gas space in the upper portion of said gas compression chamber annularly about said downwardly extending first cylinder portion, said gas inlet channels providing gaseous communication between said firing chamber and said,#converging gas space; said first piston means being arranged to cyclically open and close said gas inlet channels to permit said gaseous communication with said converging gas space; said second piston means being adapted to cyclically open and close said gas exhaust ports to control the removal of exhaust gases from said firing chamber; said first piston means cooperating with said second piston means and said fuel ignition means for controlling the charging of fresh air/fuel mixtures into said firing chamber from said gas compression chamber and the pressurization and ignition thereof in said firing chamber to generate power and to remove from said firing chamber the thus formed exhaust gases.

19. The internal combustion engine cylinder assembly according to claim 18 wherein said downwardly extending portion of said cylinder walls have a length of from about 0.4 to 1.5 times the height of said piston means.

20. The internal combustion engine cylinder assembly according to claim 19 wherein said gas inlet channels in said lower portion of said firing chamber are spaced substantially evenly about the circumference of said firing chamber.

21. The internal combustion engine cylinder assembly according to claim 20 wherein a total of from about 6 to 10 of said gas inlet channels are provided about said lower circumference in said firing chamber.

22. The internal combustion engine cylinder assembly according to claim 19, wherein each said gas inlet channel is substantially circular in cross-section and is disposed such that its center longitudinal axis forms an angle of from about 10 to 60 degrees with said vertically disposed interior walls defining said firing chamber.

* * * * *